United States Patent [19]

Kiuchi et al.

[11] Patent Number: 4,467,165

[45] Date of Patent: Aug. 21, 1984

[54] INDUCTION HEATING APPARATUS

[75] Inventors: Mitsuyuki Kiuchi, Minoo; Takumi Mizukawa, Neyagawa, both of Japan

[73] Assignee: Matsushita Electric Industrial Co., Ltd., Osaka, Japan

[21] Appl. No.: 269,059

[22] PCT Filed: Sep. 12, 1980

[86] PCT No.: PCT/JP80/00208

§ 371 Date: May 18, 1981

§ 102(e) Date: May 18, 1981

[87] PCT Pub. No.: WO81/00801

PCT Pub. Date: Mar. 19, 1981

[30] Foreign Application Priority Data

Sep. 17, 1979 [JP] Japan ..... 54-119663
Dec. 18, 1979 [JP] Japan ..... 54-165049

[51] Int. Cl.[3] ..... H05B 6/08

[52] U.S. Cl. ..... 219/10.77; 219/10.49 R; 363/21

[58] Field of Search ..... 219/10.77, 10.75, 10.49 R; 363/21, 41, 37, 131

[56] References Cited

U.S. PATENT DOCUMENTS

| | | | |
|---|---|---|---|
| 3,786,219 | 1/1974 | Kornrumpf et al. | 219/10.49 |
| 3,898,410 | 8/1975 | Peters, Jr. | 219/10.77 |
| 4,209,683 | 6/1980 | Kiuchi et al. | 219/10.77 |
| 4,277,667 | 7/1981 | Kiuchi | 219/10.77 |
| 4,356,371 | 10/1982 | Kiuchi et al. | 363/21 |

FOREIGN PATENT DOCUMENTS

| | | |
|---|---|---|
| 52-96441 | 1/1974 | Japan . |
| 1439232 | 6/1976 | United Kingdom . |
| 1472492 | 5/1977 | United Kingdom . |
| 1529114 | 10/1978 | United Kingdom . |
| 2010054 | 6/1979 | United Kingdom . |

*Primary Examiner*—Roy N. Envall, Jr.
*Assistant Examiner*—M. M. Lateef
*Attorney, Agent, or Firm*—Lowe, King, Price & Becker

[57] ABSTRACT

In an induction heating apparatus wherein heat is generated in a magnetic material by eddy currents produced by high frequency magnetic field of a heating coil (32), zero crossing point of the voltage developed in the heating coil (32) is detected and the pulse-width of a transistor (33) is controlled in synchronism with the detected zero crossing point to provide wide range power output control.

8 Claims, 7 Drawing Figures

3
VCE
33
34
32
35
VDC
30
31
2
1
45
INPUT DET
46
4
44
DRIVE CCT
43
INH
PWM
42
SYNC
41
COMP
40
OUTPUT DET
50
51
52
USER'S SETTING
49
53
LIM
54
START STOP CONT.
DIODE CIRCUIT
47
USER'S SETTING
48

INDUCTION HEATING APPARATUS

TECHNICAL FIELD

This invention relates to an induction heating apparatus having a transistor as a switching element for generating high frequency energy for heating utensils for cooking foodstuff.

TECHNOLOGICAL BACKGROUND

Over the past, thyristor inverters or transistor inverters have been employed as a high frequency energy source of induction heating apparatus in which a magnetic material is heated by eddy currents generated therein as a result of a high frequency magnetic field produced by a heating coil. Output power control methods which have been proposed are classified broadly into three categories. A first method involves carying the d.c. power voltage of the inverter, a second method involves periodically inhibiting the inverter which is called "duty cycle control", and the third method is to control the oscillating frequency of the inverter (ON-OFF duty control). However, the first method has resulted in a high apparatus cost, the second method has presented a lamp flicker problem and the problem of lengthened warmup periods, and the third method has also presented problems in that it required the use of a heavy duty power switching transistor to bear the burden of transient surge currents and high potentials. In the case of thyristor inverters, in particular, output power is variable as a function of the oscillating high frequency. Theoretically, the power loss of the switching power transistor can be decreased by lowering the oscillating frequency. However, this is achieved only at the expense of a noise generated when the frequency becomes lower than the inaudible limit. Therefore, the inaudible frequency limit sets the lower limit of power control range. Whereas, the allowable values of the surge current and high potential for the thyristor set the upper limit on the variable frequency range and hence the upper limit of the power control range. Thus, a wide range of power control was impossible with the prior art thyristor inverters. On the other hand, the problem associated with transistor inverters is concerned with difficulty in providing a wide range power control without imposing heavy burden on the switching transistor.

DISCLOSURE OF THE INVENTION

The present invention is to eliminate the aforesaid problem by varying the on-off ratio of the switching transistor without imposing heavy burden thereon. In accordance with the invention, the inverter output power is varied as a function of the conduction period of the switching transistor. The apparatus is characterized by the fact that when the power level is decreased the transistor's current and voltage decrease therewith while the oscillating frequency increases.

Another object of the invention is to achieve a quick response power control in a continuously variable range and to set the input current, i.e., the input power to a user's desired setting and the output power is delivered at an 80 per cent of the input power. The apparatus of the invention is capable of providing power control continuously over a range of 50 watts to 1500 watts, for example, without producing lamp flicker. The apparatus can be manufactured in a simplified circuit design which renders it economical.

Another object of the invention is to provide an induction heating apparatus which is stable in operation under conditions of varying loads by detecting the inverter input current and the collector voltage of the switching transistor and controlling the power level in response to the detected operating parameters through a feedback loop.

Additional object of the invention is to provide an induction heating apparatus which employs a pulse width control circuit including a synchronous ramp generator which permits wide range power control.

The invention will now be described with reference to the accompanying drawings.

DESCRIPTION OF THE PREFERRED EMBODIMENTS

Figure 1:
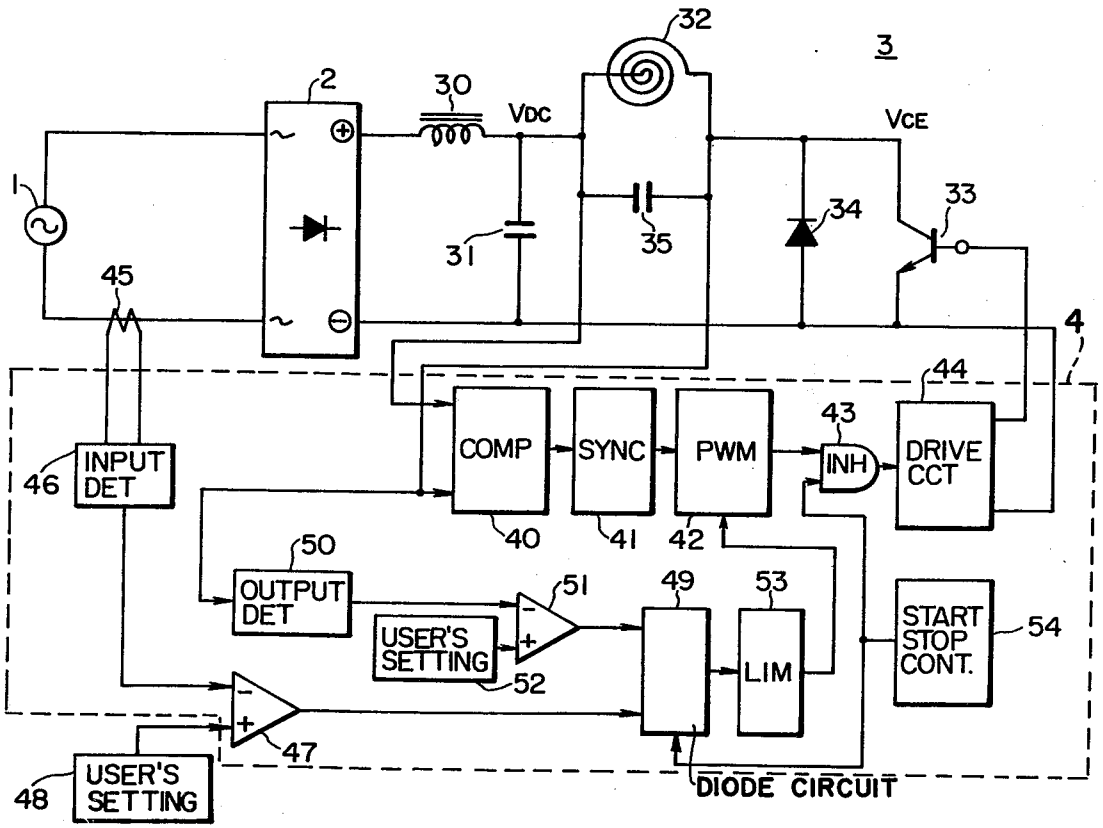
FIG. 1 is a block diagram of an embodiment of the induction heating apparatus of the present invention.

In FIG. 1, alternating current energy from an a.c. power source 1 is converted into d.c. energy in a rectifier circuit 2. The d.c. energy from the rectifier circuit 2 is applied to an inverter circuit 3 where the the input d.c. energy is converted into high frequency energy. The inverter circuit 3 comprises a choke coil 30 and an input capacitor 31 which are connected in series across the rectifier circuit 2. In parallel with the capacitor 31 is connected a series combination of a heating coil 32 and a power-rated switching transistor 33. A damper diode 34 is connected inversely parallel with the transistor 33 to form a semiconductor power switching block. In parallel with the heating coil 32 is a resonating capacitor 35 which could also be connected in series therewith to permit the inverter to oscillate at a resonance frequency.

A control circuit 4 is provided which comprises circuit elements enclosed by a broken line shown in FIG. 1.

The voltage $V_{DC}$ developed across the input capacitor 31 and the voltage $V_{CE}$ at the collector of transistor 33 are impressed on a voltage comparator 40 which detects when the collector voltage $V_{CE}$ becomes lower than the capacitor voltage $V_{DC}$ and causes a synchronizing circuit 41 to provide a sync pulse to a pulse-width modulator or pulse-width control circuit 42 for generating a base drive signal for application to the transistor 33. The output of the pulse-width modulator 42 is applied via a gate inhibit circuit 43 to drive circuit 44. The drive circuit 44 supplies the transistor 33 with a forward base current $I_{B1}$ and a reverse base current $I_{B2}$. The pulse-width modulator 42 serves to control the conduction period of the switching transistor 33 in accordance with operating circuit parameters indicative of the input and output power levels of the inverter 3. The input power level is detected by a current transformer 45 which senses the input current of the inverter 3 and applies it to an input power detector 46 where the detected input current is converted into a corresponding voltage signal. The output of the input detector 46 is applied to a first error amplifier 47 for making a comparison with an output signal for a user3 s power setting means 48 to detect the difference between them. The output signal from the first error amplifier 47 is applied to a diode circuit 49. On the other hand, the collector voltage $V_{CE}$ is applied to a collector voltage detector circuit 50 which detects the voltage $V_{CE}$ or peak value $V_{CP}$ and provides the detected voltage to a second error amplifier 51 for making a comparison with a signal from a setting circuit 52 to detect the difference between them, the difference signal being applied to the diode circuit 49. The diode circuit 49 passes the one of its input voltages which is lower than the other signal to a limiter 53 and thence to the pulse-width modulator 42. The limiter 53 serves to restrict the range of conduction period of the transistor 33 by setting the minimum and maximum values. The pulse-width modulated signal is inhibited by the inhibit gate 43 in response to a signal from a startup-inhibit control circuit 54 to start or shut off inverter operation. During inverter startup periods the pulse duration is set to a minimum value.

Figure 2:
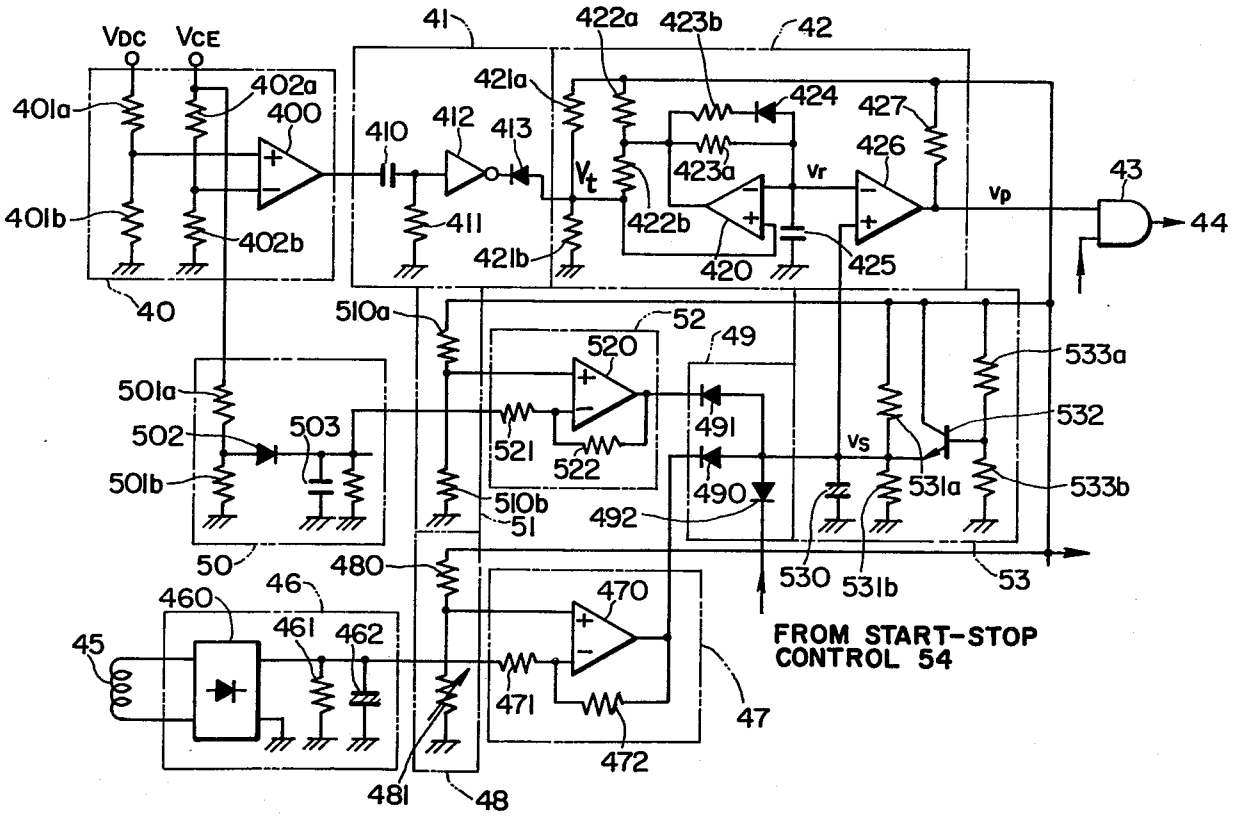
FIG. 2 is a detailed circuit diagram of the induction heating apparatus of FIG. 1.
Figure 3:
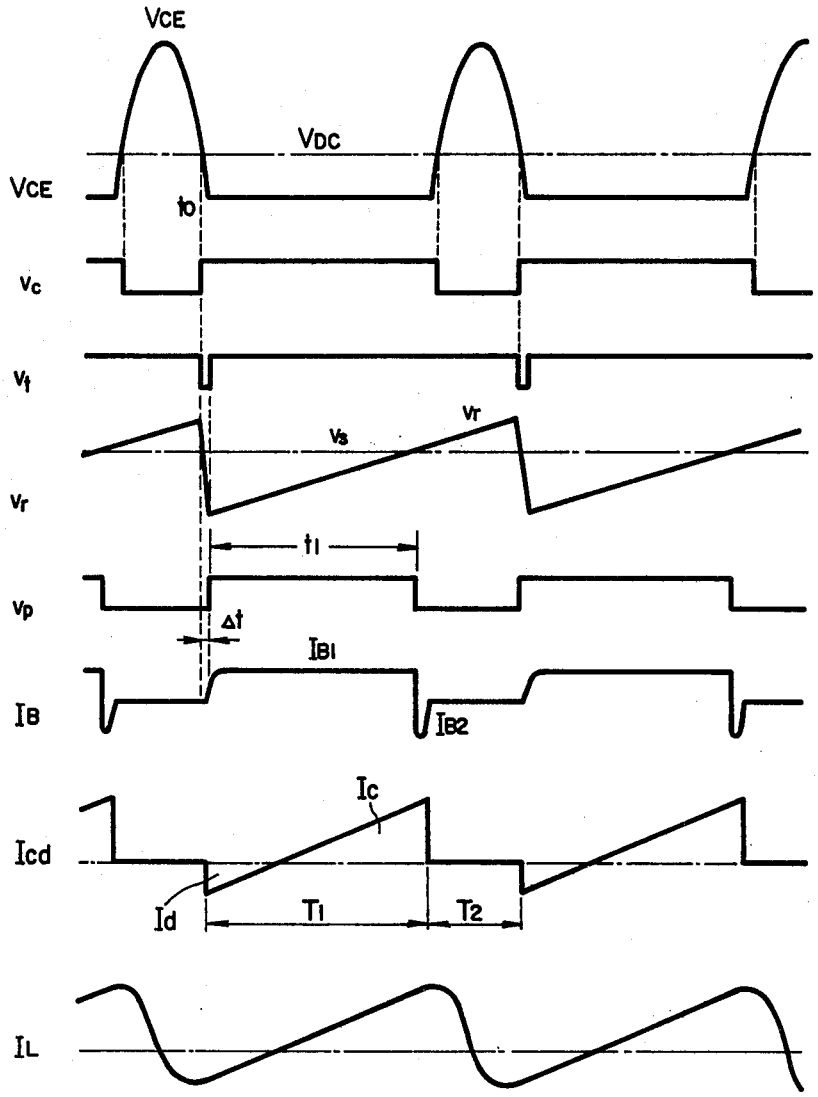
FIG. 3 is a waveform diagram of the apparatus when operating in a high output power mode.

FIG. 2 is an illustration of the detail of the control circuit of FIG. 1. The voltage comparator 40 includes a comparator 400 having an input terminal connected to receive the d.c. voltage $V_{DC}$ through a voltage divider formed by resistors 401*a* and 401*b* and another input terminal connected to receive the collector voltage $V_{CE}$ through a voltage divider formed by resistors 402*a* and 402*b*. The waveforms of voltages $V_{CE}$, $V_{DC}$ and the output voltage $V_C$ of the comparator 40 are illustrated in FIG. 3. The synchronizing circuit 41 detects the leading edge transition of the signal $V_C$ by means of a differentiating capacitor 410 and a differentiating resistor 411 and generates a trigger signal Vt from the output terminal of a diode 413 utilizing the threshold level of an inverter 412. The pulse-width modulator 42 comprises a comparator and a ramp generator of the externally synchronized, self-oscillating type. The ramp generator comprises an open-collector type comparator 420. The potential at the positive input terminal of the comparator 420 is determined by varying a voltage set by a voltage dividing network formed by resistors 421*a* and 421*b* and a voltage dividing network formed by resistors 422*a* and 422*b* in response to the ON-OFF state of the output transistor of the comparator 420. More specifically, when the comparator output transistor is in the OFF state, a capacitor 425 is charged through a circuit formed by resistors 422*a* and 423*a* and when that transistor is in the OFF state the capacitor 425 is discharged through a path formed by resistor 423*b* and a diode 424. The voltage developed in the capacitor 425 is the ramp voltage Vr. The ramp voltage Vr and a pulse-width setting signal $V_S$ are applied to a comparator 426 to generate a pulse-width controlled signal $V_P$. In response to the application of a trigger pulse $V_t$ from synchronizing circuit 41 to the pulse-width modulator 42 the input voltage to the comparator 420 is reduced to a low level which causes the timing capacitor 425 to rapidly discharge through the discharging circuit as referred to above. The ramp voltage $V_P$ is synchronized with collector voltage $V_{CE}$, but delayed by an interval introduced by the discharging circuit with respect to the output of the voltage comparator 40. The pulse duration $t_1$ of the signal $V_P$ increases as a function of the pulse width setting voltage $V_S$ to increase the inverter output power. The pulse-width controlled signal $V_P$ is applied to the drive circuit 44 via the inhibit gate 43. Forward base current $I_{B1}$ is drawn to the transistor 33 during the interval $t_1$. Subsequently, a reverse base current $I_{B2}$ is drawn to the transistor 33 when a reverse voltage is applied across the base and emitter electrodes of the transistor 33. The forward base current $I_{B1}$ starts flowing at a time which is delayed by an interval $\Delta t$ from time $t_0$ at which the voltages $V_{CE}$ and $V_{DC}$ are equal to each other and applied to the transistor 33 substantially at the same instant the damper diode 34 is rendered conductive. Thus, the collector current $I_C$ of the transistor 33 starts flowing after the forward base current has been applied thereto, so that there is little or no turn-on loss in the transistor 33. Since the collector voltage $V_{CE}$ rises exponentially in response to the turn-off of transistor 33, the turn-off loss of transistor 33 is considerably small. Current $I_L$ of substantially sinusoidal waveform flows in the heating coil 32.

The output signal from the current transformer 45 is applied to the input power detector 46 which generates an output signal proportional to the input current. The input power detector 46 comprises a rectifier circuit 460, and a filter circuit formed by a discharging resistor 461 and an integrating capacitor. The first error amplifier 47, formed by an operational amplifier and an inverting amplifier, is capable of setting the input power level to a desired value by means of the user's setting circuit formed by a resistor 480 and a variable resistor 481. Output signals from the first and second error amplifiers 47, 52 and start-stop control 54 are applied to the diode circuit 49 and the smaller of the output signals is passed through diodes 490, 491, 492. During inverter start periods, a soft start signal drives the diode 492 to as low as a level which corresponds to the minimum level of the pulse width setting voltage $V_S$ which is determined by the limiter 53, so that inverter operation may start off with a small conduction period. In the limiter circuit 53, a voltage developed in a capacitor 530 is divided by a voltage divider formed by resistors 531*a* and 531*b* to establish the upper limit and further divided by a circuit formed by a transistor 532 and resistors 533*a* 25 and 533*b* to establish the lower limit. The control circuit of the collector voltage $V_{CE}$ are substantially of the same construction as the control circuit associated with the input current. The collector voltage $V_{CE}$ increases as a function of the input d.c. voltage $V_{DC}$ or as a function of loads such as aluminum, nonferrous stainless or cast iron utensil, so that it can serve the purpose of providing protection to the inverter.

Figure 4:
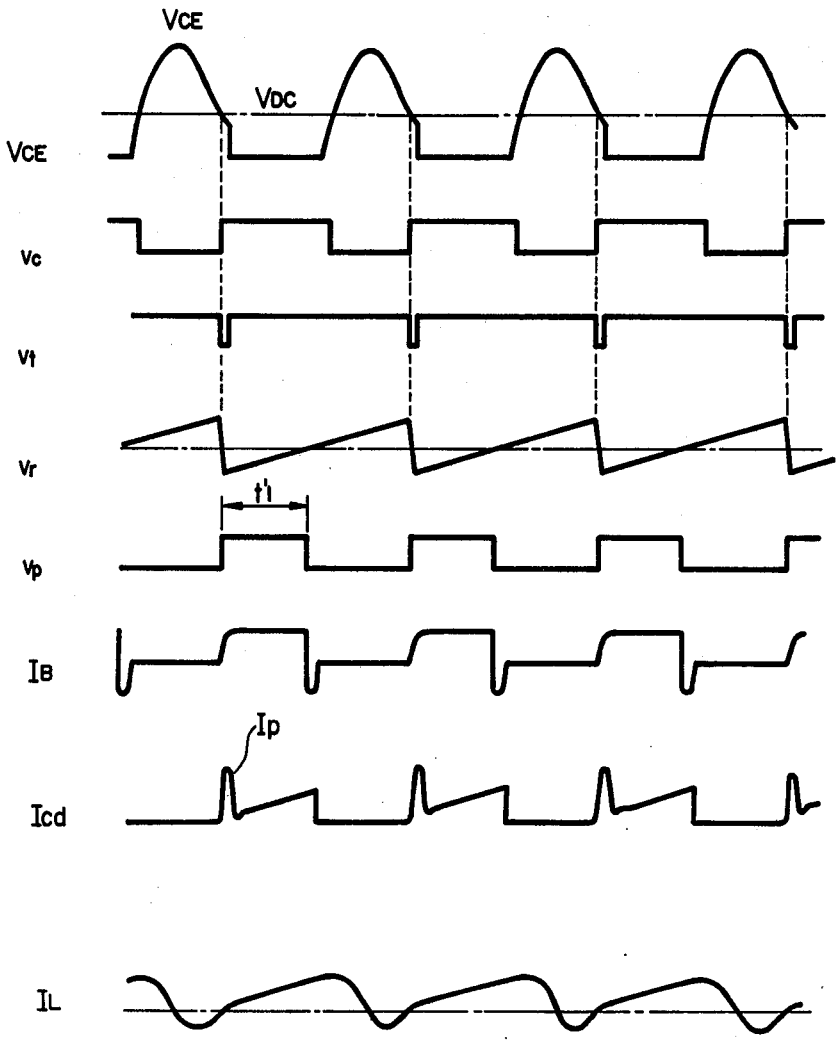
FIG. 4 is a waveform diagram of the apparatus when operating in a low output power mode.

FIG. 4 is an illustration of various waveforms which appear when the inverter is operating in a low output power mode. The inverter 3 is in a feed-forward mode. While the operational mode of the inverter 3 shown in FIG. 3 is a quasi-E class mode in which the turn-on loss of the transistor 33 is substantially zero, this turn-on loss increases substantially when the inverter operation is in the feed-forward mode of FIG. 4 due to the fact that the diode 34 is not rendered conductive. The reason for this nonconduction resides in the fact that when the switching transistor 33 has a small conduction period the electromagnetic energy stored in the heating coil 32 during that conduction period is dissipated completely in the inverter utensil load during a subsequent turn-off period of the transistor 33. Therefore, there is no energy to be regenerated or returned to the d.c. power source of the inverter 3. In this instance, the collector voltage $V_{CE}$ of transistor 33 does not become zero, and hence the voltage developed in the heating coil 32 is not higher than the d.c. voltage $V_{DC}$, as a result of which the diode 34 is not allowed to conduct. At this instant the collector voltage of transistor 33 is not driven to zero voltage, that is, the heating coil 32 voltage does not reach a level higher than the d.c. power level $V_{DC}$, so that the diode 34 remains nonconductive. Since transistor 33 is rendered conductive when its collector voltage is positive with respect to its emitter, the collector current of the transistor 33 reaches a peak current value $I_p$ and results in a turn-on loss. Since the collector current and voltage which occur at the turn-off time are not substantial, however, the total switching loss of the transistor 33 is lower than that for maximum output power operation.

Figure 5:
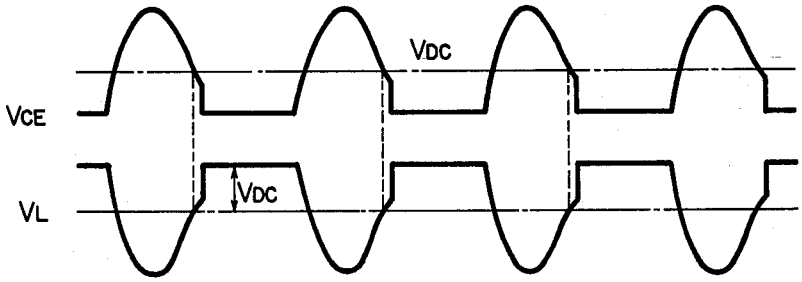
FIG. 5 is a waveform diagram illustrating the relationship between the transistor voltage $V_{CE}$ and the coil voltage $V_L$.

FIG. 5 illustrates the relationship between the collector voltage $V_{CE}$ and the voltage $V_L$ developed in the heating coil 32. Since $V_{DC}=V_{CE}+V_L$, the relation $V_L=V_{DC}-V_{CE}$ holds, so that zero voltage condition occurs in the coil 32 when the collector voltage $V_{CE}$ coincides the input d.c. voltage $V_{DC}$. Stated differently, detecting a coincidence between these voltages is equivalent to detecting the zero crossing point of the heating coil voltage $V_L$.

Figure 6:
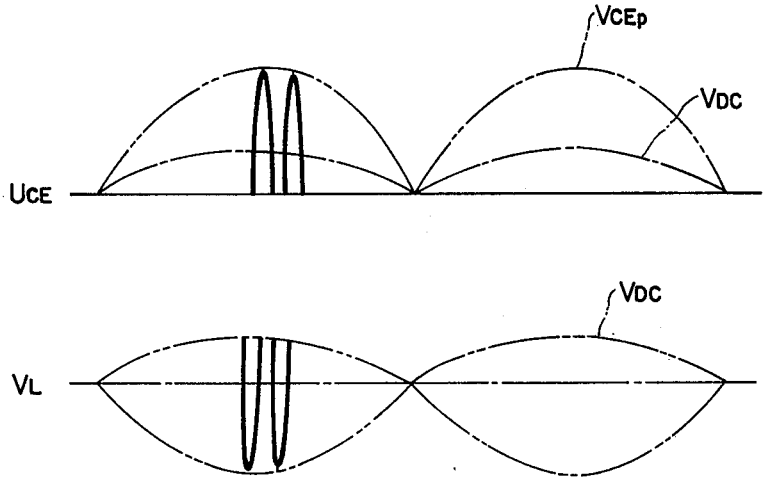
FIG. 6 is a waveform diagram illustrating the inverter waveform modulated with the a.c. input voltage.

FIG. 6 illustrates the envelopes of the voltages $V_{CE}$ and $V_L$. As illustrated in FIG. 6 the coil voltage $V_L$ never fails to cross the zero voltage level for all inverter input and output (loading) conditions.

Figure 7:
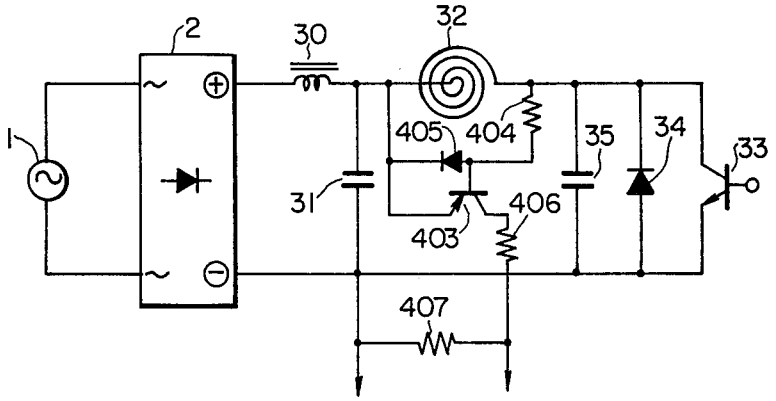
FIG. 7 is a circuit diagram of another embodiment of the detector circuit of the apparatus.

FIG. 7 is an illustration of an alternative embodiment of the voltage comparator circuit 40. In this embodiment a high-voltage-rated PNP transistor 403 is provided having its emitter connected to the d.c. input end of the coil 32 and having its base connected by a resistor 404 to the output end of the coil 32. A diode 405 is connected in anti-parallel relationship with the base-emitter electrodes of the transistor 403. The collector of transistor 403 is connected to ground by a series circuit including resistors 406 and 407. Voltage developed across the resistor 407 is used to detect the zero crossing point of the heating coil voltage.

INDUSTRIAL APPLICATION

As described in the foregoing, the inverter of the present invention oscillates in a quasi-E class mode for high output power inverter operation and oscillates in a feed-forward mode for low output inverter operation. With this switched modes of inverter operation, the present invention provides a wide range of output power control. More specifically, the advantages of the present invention are:

(1) High stability inverter operation is achieved by the detection of zero crossing point of the voltage developed in the heating coil;

(2) Inverter output power can be varied in a wide range due to the use of an externally synchronized ramp generator since it permits the conduction period of switching transistor to vary in a wide range;

(3) The utilization of the one of sensed inverter input current and sensed collector voltage of switching transistor as a means for controlling the conduction period of the latter enables the inverter to respond to a wide range of inverter loads without imposing heavy load on the switching transistor;

(4) Soft starting feature enables the inverter to operate smoothly during startup periods;

(5) Input power level and hence the inverter output can be controlled continuously in a wide range without causing lamp flicker;

(6) The inverter can quickly respond to power setting readjustment without causing overload on the switching transistor;

(7) The control circuit is made simple since it only requires to sense the inverter input current and the collector current of the switching transistor; and (8) The switching loss of the transistor is minimized to enable it to be made compact.

We claim:

1. An induction heating apparatus comprising a rectifier for rectifying a voltage from an AC mains supply, a resonance circuit formed by an induction heating coil and a capacitor, a switching transistor having an emitter-collector path connected in circuit with said heating coil to the output of said rectifier, a diode connected in anti-parallel relationship with said transistor, first means for generating a power control signal having a manually adjustable magnitude, second means for detecting when a voltage developed at a junction between the collector of said transistor and one end of said heating coil becomes lower than a voltage developed at the other end of said heating coil, and third means for generating in response to the occurrence of an output signal from said second means a trigger pulse of a variable duration adjustable as a function of said power control signal and applying said trigger pulse to the base of said transistor so that the frequency of oscillations generated in said resonance circuit is inversely proportional to said manually adjustable magnitude.

2. An induction heating apparatus as claimed in claim 1, wherein said first means comprises means for detecting the difference between the amount of input power fed from said mains supply to said apparatus and a user's power setting for generating a first differential signal, the first differential signal being applied to said third means as said power control signal.

3. An induction heating apparatus as claimed in claim 2, wherein said first means further comprises means for detecting the difference between the amount of output power withdrawn from said apparatus and said user's power setting and generating a second differential signal, and means for selectively applying the smaller of the first differential signal and said second differential signal to said third means as said power control signal.

4. An induction heating apparatus as claimed in claim 1, wherein said induction heating coil is connected in series between said transistor and said rectifier, and said second means comprises a comparator having first and second input terminals connected across said induction heating coil for generating a comparator signal having a first voltage level when said collector voltage is lower than the rectified voltage and a second voltage level when said collector voltage is higher than said rectified voltage.

5. An induction heating apparatus as claimed in claim 2, wherein said induction heating coil is connected in series between said transistor and said rectifier, and said second means comprises a comparator having first and second input terminals connected across said induction heating coil for generating a comparator signal having a first voltage level when said collector voltage is lower than the rectified voltage and a second voltage level when said collector voltage is higher than said rectified voltage.

6. An induction heating apparatus as claimed in claim 3, wherein said induction heating coil is connected in series between said transistor and said rectifier, and said second means comprises a comparator having first and second input terminals connected across said induction heating coil for generating a comparator signal having a first voltage level when said collector voltage is lower than the rectified voltage and a second voltage level when said collector voltage is higher than said rectified voltage.

7. An induction heating apparatus as claimed in claim 1, wherein said third means comprises means for generating a first, constant duration pulse in response to said second means to allow said collector voltage to fall to a level lower than said rectified voltage, a ramp generator for generating a ramp voltage in response to a trailing edge transition of said first pulse, and means for detecting the difference between said ramp voltage and said power control signal and generating a second, variable duration pulse for application to the base of said switching transistor.

8. An induction heating apparatus as claimed in claim 1, further comprising means for imposing an upper and a lower limit on said power control signal.

* * * * *